United States Patent [19]

Debaigt

[11] 4,133,597

[45] Jan. 9, 1979

[54] SUPPORT RAIL FOR TERMINAL BLOCKS

[75] Inventor: Jean Debaigt, Maisons Laffitte, France

[73] Assignee: CGEE Alsthom, Levallois Perret, France

[21] Appl. No.: 881,338

[22] Filed: Feb. 27, 1978

[30] Foreign Application Priority Data

Mar. 1, 1977 [FR] France ..... 77 05927

[51] Int. Cl.[2] ..... H01R 9/16

[52] U.S. Cl. ..... 339/125 R; 174/157; 248/226.5; 339/198 GA

[58] Field of Search ..... 174/156, 157; 248/225.3, 226.2, 226.5, 228; 339/125 R, 198 R, 198 G, 198 GA

[56] References Cited

U.S. PATENT DOCUMENTS

| | | | |
|---|---|---|---|
| 1,474,736 | 11/1923 | Schaub | 174/157 |
| 2,983,897 | 9/1963 | Blanchet | 339/198 GA |

*Primary Examiner*—Gerald A. Dost

*Attorney, Agent, or Firm*—Sughrue, Rothwell, Mion, Zinn and Macpeak

[57] ABSTRACT

The support rail is intended to allow access both to the back and to the front of through-connecting connection blocks mounted on the support rail to form a connecting strip. The support rail is constituted by two bars held parallel to each other by two spacers which are spaced apart from each other and each of which comprises a parallelepipedical insulating block which has an upper surface, a lower surface, two longitudinal walls and two side surfaces, said block having a transverse channel which is parallel to each of said longitudinal walls, and which has a cross-section which corresponds to that of the bars and which has one of the bars passing through it, said channel having, on the side of the longitudinal wall a longitudinal slot which is open to said longitudinal wall and on the other side a longitudinal slot through which a tightening screw passes which is disposed through the block between its upper surface and its lower surface.

4 Claims, 3 Drawing Figures

SUPPORT RAIL FOR TERMINAL BLOCKS

FIELD OF THE INVENTION

The invention relates to a support rail for supporting terminal blocks to produce a connecting strip.

BACKGROUND OF THE INVENTION

Support rails are generally made from sections, most of which are standardized, but which are unsuitable when terminal blocks of the through type are used. In this type of terminal block, connections are made between an upper surface of the terminal block and a lower surface thereof, access to which is normally impeded by the section on which the connector is fixed.

Preferred embodiments of the present invention provide support rails for terminal blocks, these support rails being simple to produce and providing complete accessibility to the lower surface of the terminal blocks which are intended to be fixed on these support rails.

SUMMARY OF THE INVENTION

The invention provides a support rail for terminal blocks. The support rail is constituted by two bars held parallel to each other by two spacers which are spaced apart from each other and each of which comprises a parallelepipedical insulating block which has an upper surface a lower surface, two longitudinal walls and two side surfaces. The block has a transverse channel which is parallel to each of said longitudinal wall, and which has a cross-section which corresponds to that of the bars and which has one of the bars passing through it, said channel having, on the side of the longitudinal wall a longitudinal slot which is open to said longitudinal wall and on the other side a longitudinal slot through which a tightening screw passes which is disposed through the block between its upper surface and its lower surface.

According to one characteristic, the bars are constituted by two flat iron bars disposed parallel and face to face.

According to another characteristic, the tightening screw constitutes means for fixing the spacer on a support.

According to another characteristic, the rail acts as a support for a through-connecting terminal block fixed on the profile by means of resilient fixing tabs.

An embodiment of the invention is described by way of an example with reference to the accompanying drawings.

DESCRIPTION OF THE PREFERRED EMBODIMENT

Figure 1:
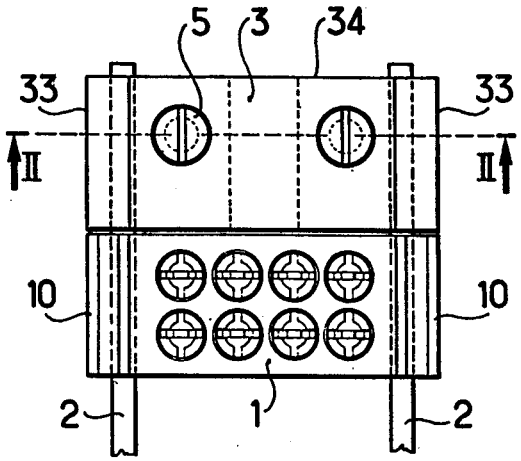
FIG. 1 is a partial top view of a connecting strip which includes a support rail in accordance with the invention.
Figure 2:
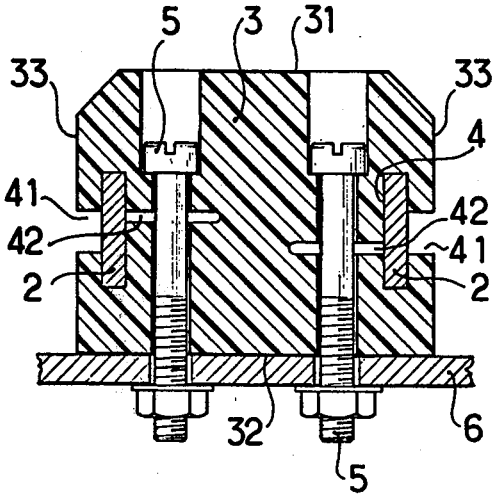
FIG. 2 is a cross-sectional view along line II–II' of the support rail of claim 1.
Figure 3:
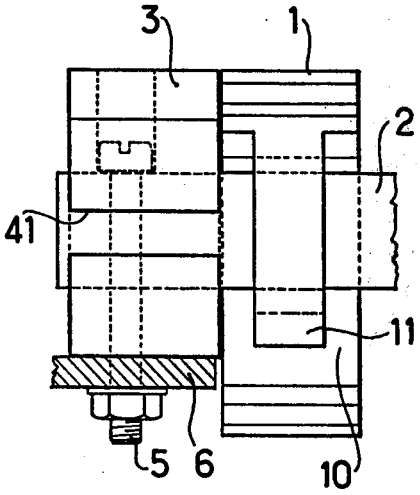
FIG. 3 is a side profile view of FIG. 1.

The figures show a partial view of a connecting strip having a row of terminal blocks 1 disposed side by side. On their longitudinal faces 10, the terminal blocks 1 include resilient tabs 11 for fixing thereon, sections in the shape of flat iron bars 2 which are disposed face to face and parallel to each other.

The support rail of the connecting strip is constituted firstly by the bars 2 and secondly by two spacers such as 3, which are spaced apart from each other and only one of which is shown. The spacer 3 is constituted by an insulating block which is generally rectangular having an upper surface 31, a lower surface 32, two longitudinal walls 33 and two side surfaces 34. A longitudinal channel 4 is formed on each side, parallel to the longitudinal walls 33 and in the proximity of these walls. The outline of the channel 4 fits that of the bar 2 on which it is fitted. A longitudinal slot 41 is provided between the channel 4 and the longitudinal wall 33, while on the opposite side a thinner slot 42 is provided extending towards the central part of the spacer 3. A screw 5 disposed between the upper surface 31 and the lower surface 32 of the spacer passes through the slot 42. The lower surface 32 is disposed on a support 6 and the screw 5 also passes through the support 6.

To form the support rail, each of the two bars 2 is passed through a respective one of the channels 4 of a first spacer 3, then the bars are passed through the channels of a second spacer which is set apart from the first spacer (not shown) at a suitable distance therefrom. The bars can then be fixed either by tightening the screws 5 as they stand or after the screws have been fixed through the support. In both cases, the presence of the slot 42 makes it possible to provide resilient tightening for fixing the bars and possibly for fixing the support rail on the support 6.

The terminal blocks 1 which have resilient longitudinal fixing tabs can easily be inserted on the bars 2 in the gap between the spacers of the support rail thus constituted.

What is claimed is:

1. A support rail for terminal blocks, the support rail being constituted by two bars held parallel to each other by at least one spacer, said at least one spacer comprising a parallelepipedical insulating block which has an upper surface, a lower surface, two longitudinal walls and two side surfaces, said block having a transverse channel which is parallel to each of said longitudinal walls, and which has a cross-section which corresponds to that of the bars and which has one of the bars passing through it, said block at said channel having, on the side of the longitudinal wall a longitudinal slot which is open to said longitudinal wall and on the other side a longitudinal slot and a tightening screw passing through the block between its upper surface and its lower surface.

2. A support rail according to claim 1, wherein the bars are constituted by two flat iron bars disposed parallel and face to face.

3. A support rail according to claim 1, wherein the tightening screw constitutes means for fixing the spacer on a support.

4. A support rail according to claim 1, further comprising through-connecting terminal blocks disposed on one of its side surfaces and being fixed on the bars by means of resilient fixing tabs.

* * * * *